US011112085B2

(12) United States Patent
Hikmet et al.

(10) Patent No.: US 11,112,085 B2
(45) Date of Patent: Sep. 7, 2021

(54) LIGHTING DEVICE HOUSING, LUMINAIRE AND METHOD OF MANUFACTURE

(71) Applicant: SIGNIFY HOLDING B.V., Eindhoven (NL)

(72) Inventors: Rifat Ata Mustafa Hikmet, Eindhoven (NL); Bert Wouters, Veldhoven (NL); Paulus Albertus Van Hal, Waalre (NL); Johannes Petrus Maria Ansems, Hulsel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/770,001

(22) PCT Filed: Dec. 4, 2018

(86) PCT No.: PCT/EP2018/083437

§ 371 (c)(1),
(2) Date: Jun. 4, 2020

(87) PCT Pub. No.: WO2019/115285

PCT Pub. Date: Jun. 20, 2019

(65) Prior Publication Data

US 2021/0207785 A1 Jul. 8, 2021

(30) Foreign Application Priority Data

Dec. 15, 2017 (EP) ..... 17207608

(51) Int. Cl.
*F21V 7/00* (2006.01)
*F21V 7/06* (2006.01)
(Continued)

(52) U.S. Cl.
CPC ..... *F21V 7/005* (2013.01); *F21S 4/28* (2016.01); *F21V 7/06* (2013.01); *F21Y 2115/10* (2016.08)

(58) Field of Classification Search
CPC ..... F21V 7/005; F21S 4/28; F21Y 2115/10
See application file for complete search history.

(56) References Cited

U.S. PATENT DOCUMENTS 9,488,329 B2 11/2016 Lay et al.
9,719,637 B2 8/2017 Boonekamp et al.
(Continued)

FOREIGN PATENT DOCUMENTS

EP 3199868 A1 8/2017
EP 3217091 A1 9/2017
(Continued)

*Primary Examiner* — Evan P Dzierzynski
(74) *Attorney, Agent, or Firm* — Daniel J. Piotrowski

(57) ABSTRACT

A housing (10) for a lighting device is disclosed. The housing comprises an elongate base region (21) and opposing elongate sidewalls (23) extending from opposite elongate sides of the elongate base region towards respective terminal ends (24), wherein each of the opposing elongate sidewalls (23) has an optically transmissive inner surface (11) separated from an outer surface (13) by a distance of 5 millimeters or less to form a cavity (15) for housing a reflective foil or a thermally conductive member. The inner surface (11) extends across the elongate base region (21), and it comprises a recess (25) in the elongate base region (21) for housing a light engine (31). Also disclosed is a luminaire (1) including such a housing (10) and a method of manufacturing such an optically transmissive housing (10).

14 Claims, 9 Drawing Sheets

(51) Int. Cl.
*F21S 4/28* (2016.01)
*F21Y 115/10* (2016.01)

(56) References Cited

U.S. PATENT DOCUMENTS

| | | | | |
|---|---|---|---|---|
| 2003/0218879 | A1 | 11/2003 | Tieszen | |
| 2005/0111235 | A1* | 5/2005 | Suzuki | F21S 43/14 362/555 |
| 2014/0043856 | A1 | 2/2014 | Thompson et al. | |
| 2015/0252965 | A1 | 9/2015 | Edwards | |
| 2015/0276189 | A1* | 10/2015 | Palfreyman | G06F 1/1616 362/235 |
| 2016/0061389 | A1* | 3/2016 | Dong | F21V 7/0025 362/297 |
| 2016/0113118 | A1 | 4/2016 | Pereyra et al. | |
| 2016/0123560 | A1* | 5/2016 | Catalano | F21V 14/04 362/217.06 |

FOREIGN PATENT DOCUMENTS

| | | | |
|---|---|---|---|
| FR | 2623599 | A1 | 5/1989 |
| JP | 2016046264 | A | 4/2016 |
| WO | 2011034178 | A1 | 3/2011 |
| WO | 201517594 | A1 | 11/2015 |
| WO | 2017118565 | A1 | 7/2017 |

* cited by examiner

1

10

LIGHTING DEVICE HOUSING, LUMINAIRE AND METHOD OF MANUFACTURE

CROSS-REFERENCE TO PRIOR APPLICATIONS

This application is the U.S. National Phase application under 35 U.S.C. § 371 of International Application No. PCT/EP2018/083437, filed on Dec. 4, 2018, which claims the benefit of European Patent Application No. 17207608.5, filed on Dec. 15, 2017. These applications are hereby incorporated by reference herein.

FIELD OF THE INVENTION

The present invention relates to a housing for a lighting device, said housing comprising an elongate base region and opposing elongate sidewalls extending from opposing elongate sides of the elongate base region towards respective terminal ends.

The present invention further relates to a luminaire comprising such a housing and a light engine.

The present invention further relates to a method of manufacturing such a housing.

BACKGROUND OF THE INVENTION

Solid state lighting such as LED lighting is rapidly gaining popularity due to the green credentials of such lighting. Typically, solid state lighting (SSL) devices produce their luminous outputs at a fraction of the energy consumption of incandescent or halogen lighting devices. In addition, solid state lighting devices have superior lifetimes compared to incandescent and halogen lighting devices, which at least partially is due to the increased robustness of SSL devices against impacts compared to such more traditional light sources. This has led to the emergence of a wide range of SSL-based lighting devices, ranging from light bulbs to complex luminaires.

One particular challenge associated with SSL devices is to achieve a luminous output that resembles that of a traditional light source. This is important as end users are used to expect a luminous output of such traditional light sources, and deviating luminous outputs can be perceived as unpleasant or inferior. The solutions to such challenge are far from trivial, due to the fact that SSL elements typically generate a Lambertian luminous distribution, which is distinctly different to the omnidirectional luminous distributions produced by traditional light sources. In addition, as such SSL devices approximate point sources, a rather high luminance is perceived when looking directly at such SSL devices, which can cause glare to the observer when such SSL devices can be directly observed.

Consequently, a housing of such SSL devices typically comprises a range of beam shaping measures, such as (specular or diffuse) reflectors, diffusers, lenses, collimators to name but a few. Such beam shaping measures may add to the manufacturing cost of the luminaire. For example, in linear and area luminaires such as troffers and wall washers, a reflective coating may need to be applied to the light source-facing surfaces of the housing in order to shape the luminous distribution produced with the luminaire and enhance its optical efficiency. The application of such coatings is time-consuming and therefore costly. Alternatively, such as disclosed in U.S. Pat. No. 9,488,329 B2, a light fixture with a textured reflector surface may be provided to minimize glare effects. The textured surface may be formed by surface roughening, using an imprinted pattern or by extrusion. This also is a rather complex solution, which may be costly to produce.

SUMMARY OF THE INVENTION

The present invention seeks to provide a housing for a lighting device in which additional components for supporting the operation of SSL elements assembled therein can be easily added.

The present invention further seeks to provide a luminaire including such a housing.

The present invention yet further seeks to provide a method of manufacturing such a housing.

According to an aspect, there is provided a housing for a lighting device, wherein the housing comprises an elongate base region and opposing elongate sidewalls extending from opposite elongate sides of the elongate base region towards respective terminal ends, and wherein each of the opposing elongate sidewalls has an optically transmissive inner surface separated from an outer surface by a distance of 5 millimeters or less to form a cavity for housing a component such as a reflective foil or a thermally conductive member. The inner surface extends across the elongate base region, and it comprises a recess in the elongate base region for housing a light engine.

The present invention is based on the insight that by providing a double-skinned optically transmissive housing, i.e. a housing containing an optically transmissive inner surface separated from an outer surface by a cavity, additional components can be housed in the cavity of the optically transmissive housing. Such additional components for example may take the shape of a foil or the like that can be easily slide into the cavity in order to support the operation of a SSL device arrangement in the base region of the optically transmissive housing.

In at least some embodiments, the cavity in the opposing elongate sidewalls and the recess in the elongate base region are interconnected to form a single cavity that extends across the opposing sidewalls and the elongate base region. The optically transmissive housing may be optically transparent or alternatively may be optically translucent. Where reference is made to the optically transmissive housing, it should be understood that this refers to at least the inner surface being optically transmissive, although the inner surface may have the same optical transmittance as the outer surface, i.e. the outer surface may also be optically transmissive, in which case the inner surface and outer surface may be made of the same material, which makes the optically transmissive housing straightforward to manufacture.

The inner surface is separated from the outer surface by a distance of 5 millimeters or less. For example, the inner surface may be separated from the outer surface by a distance in a range of 0.1 to 5 millimeters. When the cavity has this width, it is wide enough to house the aforementioned additional components whilst ensuring that the optically transmissive housing does not become too bulky, which may hamper installation of a luminaire including the optically transmissive housing. These dimensions are particularly suited for the insertion of common components such as a reflective foil into the cavity. However, it should be understood that different widths of the cavity, e.g. down to 5 microns equally may be contemplated. It is furthermore noted that the width of the cavity is not necessarily constant across the housing but may exhibit width variations, e.g. in locations where a recess or pocket is formed in at least one of the inner surface and the outer surface to house an electrical component such as a sensor, driver, contact, and so on.

In a preferred embodiment, the housing is made of a polymer or polymer blend. Such materials are relatively cheap and facilitate the manufacture of the optically transmissive housing by a range of manufacturing techniques such as extrusion and most notably 3-D printing.

The optically transmissive housing may further comprise a light exit window extending across the respective terminal ends of the opposing elongate sidewalls distal to the elongate base region. Such a light exit window may act as a front cover of the optically transmissive housing, which can assist in protecting the inner surface of the optically transmissive housing from damage or contamination, whilst furthermore providing another surface that can be utilized for tuning the optical performance of a luminaire including the optically transmissive housing. For example, the light exit window may act as a diffuser in order to diffuse the luminous output of the luminaire.

Alternatively, in an embodiment where the luminaire is to produce a well-defined beam shape, the light exit window carries a pattern of beam shaping elements for shaping a luminous output emanating from the elongate base region. Such beam shaping elements for example may be refractive, e.g. micro-lenses, or may be totally internally reflective, e.g. Fresnel prisms, or may be a combination thereof. In yet another embodiment, the light exit window is double-skinned such that the cavity extends into the light exit window. In other words, in this embodiment the inner surface and the outer surface of the housing are closed structures encompassing the whole housing, thereby forming the double-skinned light exit window opposite the base region of the housing. Such a double-skinned light exit window may be used to house an optical component such as a diffuser foil for example.

The inner surface comprises a recess in the elongate base region for housing a light engine. In the context of the present application, a recess is formed in a section of the inner surface, e.g. by locally altering the shape of the inner surface, thereby typically forming a space in between the inner surface and outer surface, e.g. an alcove or pocket, in which a light engine may be housed. Such a recess may further carry a plurality of beam shaping elements in order to shape the luminous output produced by such a light engine. The recess can be an elongate recess that extends parallel to the elongate base region, for housing an elongate light engine, such as a elongate strip carrying a plurality of LEDs. Instead of a recess, the inner surface may comprise an opening in the elongate base region for housing a light engine.

In an embodiment, said recess has a parabolic cross-section. Alternatively, the recess comprises a first elongate surface portion adjoining a further elongate surface portion along the elongation direction of the base region under a non-zero angle. This for example may be used to generate a bat wing-like luminous distribution.

The optically transmissive housing may have a parabolic cross-section in a direction perpendicular to the elongation direction of the elongate base region to assist in producing a highly directional luminous output.

The optically transmissive housing may further comprise a plurality of joins extending across the housing in a direction perpendicular to the elongation direction of the elongate base region. Such joins for instance may be formed when the optically transmissive housing is formed by 3-D printing such as fused deposition modelling, where adjoining filaments cause the formation of such joins, e.g. ribs. Importantly, by adjoining such filaments in a direction perpendicular to the elongation direction of the optical housing rather than in parallel therewith, the optical performance of the optically transmissive housing is improved as it surprisingly has been found that when such joins run perpendicular to the elongation direction of the optically transmissive housing, the joins do not substantially interfere with the beam shaping and may contribute to a further beam narrowing effect.

According to another aspect, there is provided a luminaire comprising the optically transmissive housing of any of the herein described embodiments and at least one light engine mounted within of the optically transmissive housing. For example, the at least one light engine may be located within the elongated base region, said at least one light engine facing the inner surface in preferred embodiments. The at least light engine may be housed in the recess within the base region or may protrude through the opening in the inner surface section of the base region as explained above. Such a luminaire can be assembled in a quick and straightforward manner, thereby providing a low-cost luminaire. The luminaire may take the shape of a linear or area luminaire such as a troffer or wall washer although embodiments of the present invention are not limited thereto.

The at least one light engine may comprise an elongate strip carrying a plurality of said light engines that extends along the elongation direction of the optically transmissive housing. The light engines preferably are SSL devices although embodiments of the present invention are not limited thereto.

In a preferred embodiment, the luminaire further comprises at least one of a reflective foil extending into further portions of the cavity located within the opposing side walls; a thermally conductive member extending into said further portions of the cavity; and a diffuser foil in the light exit window where the light exit window is double-skinned. This exploits an important advantage of the optically transmissive housing of the present invention as such elements can be quickly inserted into the further portions of the cavity in a simple and straightforward manner, thereby lowering the cost of the luminaire.

The luminaire may further comprise one or more recesses formed in at least one of the inner surface and the outer surface of the optically transmissive housing, with at least one electrical component being housed in each of said recesses. Such recesses or pockets may be readily formed in the optically transmissive housing and can be utilized to assemble the luminaire in a straightforward manner.

In an embodiment, the luminaire comprises a plurality of said optically transmissive housings neighboring each other in a direction perpendicular to the respective elongation directions of said housings. In such a manner, a large area luminaire may be formed in a cost-effective manner.

According to yet another aspect, there is provided a method of manufacturing the optically transmissive housing of any of the herein described embodiments, the method comprising providing a 3-D printing apparatus comprising an extruder nozzle having at least one filament feeder for feeding a preformed filament through the nozzle; 3-D printing a plurality of abutting filaments with the 3-D printing apparatus, each of said printed filaments defining a portion of the optically transmissive housing including a section of the inner surface and the outer surface, said portion extending in a direction perpendicular to the elongation direction of the optically transmissive housing. Such an optically transmissive housing can be quickly and cheaply formed in this manner, in particular when the 3-D printing technique is fused deposition modelling, wherein during printing the displacement in the z-direction of the extruder nozzle relative to the print platform is chosen to be parallel to the length of the elongated base region. Moreover, as the joins between the abutting filaments run perpendicular to the elongation direction of the optically transmissive housing, the optical performance of the optically transmissive housing is not significantly deteriorated by the presence of such joins. In fact, such joins in this orientation may assist in improving the beam shaping characteristics of the optically transmissive housing as previously explained.

The extruder nozzle may have a plurality of filament feeders and said 3-D printing may comprise printing at least some of the abutting filaments in parallel in order to accelerate the manufacturing process of the optically transmissive housing.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
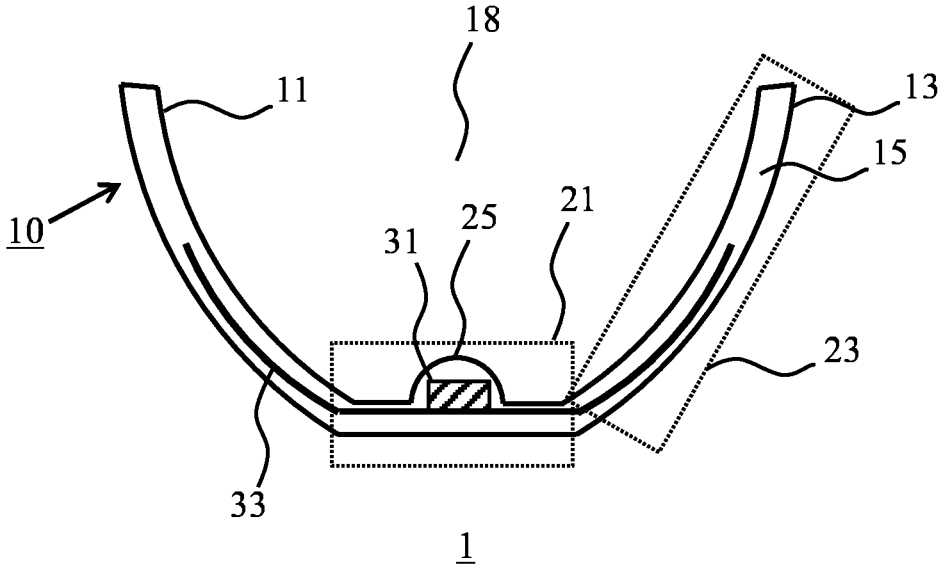
FIG. 1 schematically depicts a cross-sectional view of a luminaire and optically transmissive housing according to an embodiment.

It should be understood that the Figures are merely schematic and are not drawn to scale. It should also be understood that the same reference numerals are used throughout the Figures to indicate the same or similar parts.

Figure 2:
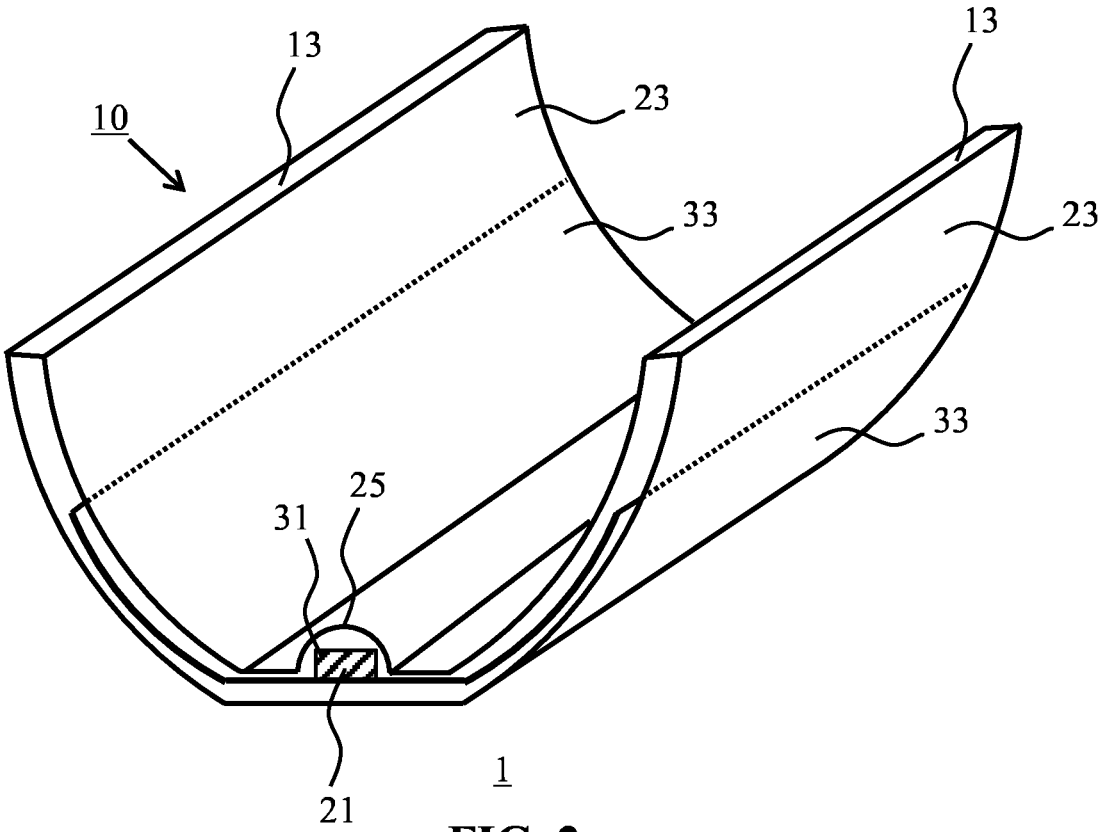
FIG. 2 schematically depicts a perspective view of a luminaire and optically transmissive housing according to an embodiment.

FIG. 1 depicts a cross-sectional view and FIG. 2 schematically depicts a perspective view of a luminaire 1 based on an optically transmissive housing 10 according to an embodiment of the present invention. The optically transmissive housing 10 comprises an inner surface 11 and an outer surface 13 separated from the inner surface 11 by a cavity 15 that may extend over the entire length of the inner surface 11 and outer surface 13. At least the inner surface 11 is optically transmissive such as optically transparent or translucent. The outer surface 13 may have any optical characteristics, e.g. may be optically transmissive or opaque although preferably the inner surface 11 and the outer surface 13 are made of the same material such that the optically transmissive housing 10 can be formed in a straightforward manner, as will be explained in further detail below. The inner surface 11 and the outer surface 13 preferably are made of a polymer or a polymer blend such that the optically transmissive housing 10 can be formed using straightforward manufacturing techniques such as extrusion and 3-D printing such as fused deposition modelling (FDM), with the latter manufacturing technique being particularly preferred as will be explained in further detail below. The cavity 15 typically has a width, i.e. the inner surface 11 is separated from the outer surface 13 by a distance of 5 millimeters or less, such as a distance in the range of 0.1 to 5 millimeters when common components, e.g. foils are to be stored in the cavity 15. However, other dimensions of the cavity 15 may be contemplated as well. As will be explained in more detail with the aid of FIG. 3, the cavity may locally vary in width, for example in case of the inclusion of a recess of pocket in the inner surface 11 and/or outer surface 13 of the housing 10, e.g. to store electrical components in such a recess or pocket.

More specifically, the optically transmissive housing 10 typically comprises an elongate base region 21 in which one or more light engines 31 may be housed. For example, an elongate strip carrying a plurality of such light engines 31, e.g. SSL elements such as white light or coloured LEDs, may be housed in the elongate base region 21 along its elongation direction. Adjacent to the elongate base region 21, the optically transmissive housing 10 typically comprises a pair of opposing, i.e. facing, sidewalls 23 that each extend from an elongate side of the base region 21. It is noted for the avoidance of doubt that the base region 21 and the sidewalls 23 are not necessarily discrete structures but may merely define different regions of a continuous optically transmissive housing 10. It is further noted that the cavity 15 may extend across the entire optically transmissive housing 10 or alternatively may only be present in the sidewalls 23, in which case (part of) the inner surface 11 or outer surface 13 may be missing in the elongate base region 21.

The sidewalls 23 typically extend upwardly (or downwardly depending on the orientation of the luminaire 1) from the elongate base region 21 of the optically transmissive housing 10, thereby forming a chamber 18 into which the light emitted by the one or more light engines 31 in the base region 21 is emitted. The portions of the cavity 15 within the sidewalls 23 may contain a reflective member 33 such as a specularly or a diffusively reflective foil that helps to shape the luminous distribution produced by the one or more light engines 31 within the base region 21. The shape of the sidewalls 23 may be chosen to further assist in the shaping of such a luminous distribution as will be explained in further detail below. Such a member 33 can be easily inserted into the cavity 15 during assembly of the luminaire 1, after which the optically transmissive housing 10 may be sealed to waterproof the optically transmissive housing 10. It should be understood that the member 33 inserted into the portions of the cavity 15 in the sidewalls 23 is not necessarily an optical member. For example, the member 33 may be a thermally conductive member thermally coupled to the one or more light engines 31, e.g. a flexible heatsink member that assists in controlling the operating temperature of the one or more light engines 31, as is well-known per se. The one or more light engines 31 may be mounted on such a flexible heatsink member or alternatively the flexible heatsink member may be thermally coupled to a separate carrier of the one or more light engines 31. It should furthermore be understood that the portions of the cavity 15 in the sidewalls 23 may house a combination of an optical member and a thermally conductive member, in which case the optical member typically faces the inner surface 11 and the thermally conductive member typically faces the outer surface 13. In yet another embodiment, the member 33 may combine optical and thermal capabilities, e.g. a specularly or diffusively reflective metal foil 33.

The elongate base region 21 may comprise a recess 25 in the region of the inner surface 11 of the base region 21 for housing the one or more light engines 31. Such a recess 25 may provide additional room for the one or more light engines 31 to be housed. The recess 25 may have a cross-sectional shape in a direction perpendicular to the elongation direction of the elongate base region 21 that is shaped to assist the positioning of one or more carriers carrying a plurality of light engines 31, as will be explained in more detail below. For example, in FIGS. 1 and 2 the recess 25 is dome-shaped by way of non-limiting example, as other shapes, e.g. a recess 25 having a box-shaped or triangular cross-section, are equally feasible. The recess 25 may further assist in electrically insulating the one or more light engines 31; in other words, the recess 25 protects against accidental electrocution when a person attempts to touch the one or more light engines 31 when these light engines are conductively coupled to a power supply such as a mains power supply. The recess 25 may further carry an optical component, e.g. a diffuser foil or the like (not shown), which may be adhered to the inner or outer section of the inner surface 11 defining the recess 25 or otherwise inserted into the recess 25 to further shape the luminous output of the one or more light engines 31.

Figure 3:
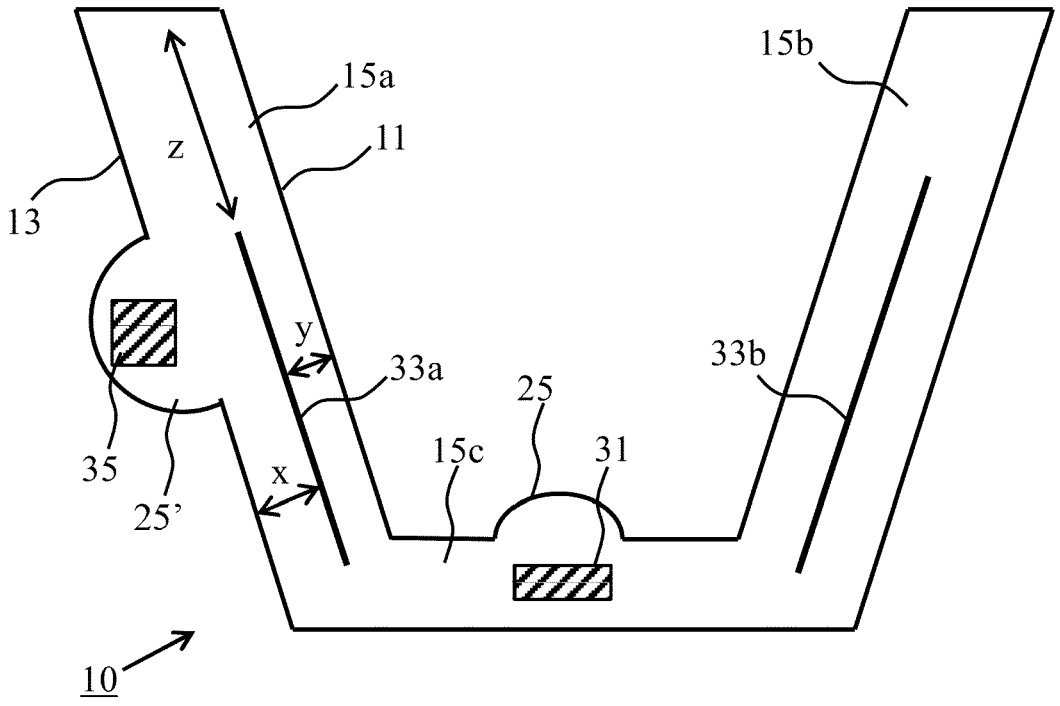
FIG. 3 schematically depicts a cross-sectional view of a luminaire and optically transmissive housing according to another embodiment.

At this point, it is noted that many design variations of the luminaire 1 are possible when using the housing 10, as will be explained in more detail with the aid of FIG. 3, in which a cross-sectional view of such a luminaire 1 according to an example embodiment is depicted. For example, the housing 10 may comprise any suitable number of recesses or pockets, which is symbolically represented by recess or pocket 25' in the outer surface 13 of one of the sidewalls of the housing 10. Such recesses or pockets may be located in any suitable location within the housing 10, such as in the inner surface 11, the outer surface 13 or in both the inner surface 11 and the outer surface 13, in any suitable part of the housing 10, e.g. within one of the sidewalls 23 or within the base region 21 as previously explained. Such recesses or pockets may be utilized in some embodiments to house electrical components 31, 35 of the luminaire 1 such as sensors, drivers, light engines, electrical contacts and so on.

The cavity within the housing 10 may be divided in compartments 15*a*, 15*b* in the opposing sidewalls 23 and a compartment 15*c* in the base region 21. The compartments 15*a*, 15*b* may each comprise an inserted member 33*a*, 33*b* such as a foil, which members do not need to be the same or have the same dimensions. For example, in case of both members 33*a*, 33*b* being reflective foils, the dimensions of the respective foils may be different, for example to create a particular luminous distribution with the luminaire 1 that is non-symmetrical in this cross-sectional view. Alternatively, the member 33*a* may be an optical member such as a reflective foil and the member 33*b* may be a thermal member such as a heatsink foil.

Also, any suitable positioning of such members within the cavity of the housing 10 may be contemplated, as schematically depicted by the clearances x, y, z of the member 33*a* within the cavity compartment 15*a*, in which x, y and z may be any suitable value. In some embodiments, y or x may be zero such that the member is attached to the inner surface 11 or the outer surface 13 respectively. As will be understood from the foregoing, the clearance of the member 33*a* may be different to the clearance of the member 33*b*, and so on. It is noted for the avoidance of doubt that such members may be secured within the cavity 15 of the housing 10 in any suitable manner, of which adhesion is just one of many examples.

Many more design variations are of course possible. As a further example, it is mentioned that a member inserted into the cavity of the housing 10 may extend through the cavity compartments 15*a*, 15*b* and 15*c*, with the light engine 31 (thermally) coupled to the member, e.g. in case the member acts as a heatsink for the light engine 31. Moreover, multiple members may be present within one or more the compartments 15*a*, 15*b* and 15*c* of the cavity 15 of the housing, and so on. Moreover, the one or more light engines 31 are not necessarily positioned in the base region 21 of the housing but instead or additionally be positioned in one or more of the sidewalls 23.

It is furthermore noted that although the optically transmissive housing 10 is shown to have opposing sidewalls 23 having the same dimensions, this is by way of non-limiting example only. The opposing sidewalls 23 may have different dimension, e.g. the respective cavity compartments 15*a* and 15*b* may have different widths and/or heights, thereby yielding an optically transmissive housing 10 having a non-symmetrical cross section in a plane perpendicular to its elongation direction.

Also, it is noted that although the one or more light engines 31 are arranged to emit light directly into the chamber 18, it is equally feasible to provide an arrangement in which the one or more light engines are mounted proximal to or on the inner surface 11 of the optically transmissive housing 10 and arranged to emit their luminous output towards the outer surface 13 of the optically transmissive housing 10. A reflective foil may be arranged to the outer surface 13 such that the light emitted by the one or more light engines 31 is reflected back into the chamber 18, thereby providing an indirectly lit luminaire 1, which for example may be beneficial to avoid or reduce glare.

Figure 4:
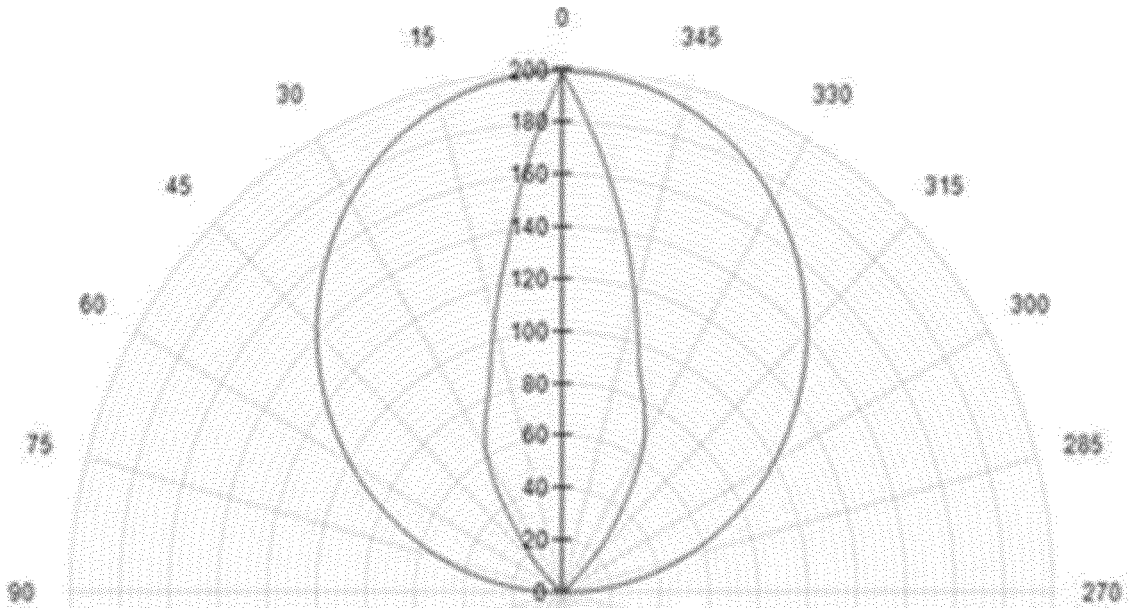
FIG. 4 is a polar plot of a luminous distribution produced by a luminaire according to an embodiment.

Now, upon returning to FIG. 1, where the member 33 is an optical member such as a highly reflective foil, the cross-sectional shape of the optically transmissive housing 10 perpendicular to its elongation direction may be chosen to assist with the beam shaping of the luminous output of the one or more light engines 31 within the elongate base region 21. For example, the cross-sectional shape of the optically transmissive housing 10 may be parabolic in nature such that the reflective foil within the portions of the cavity 15 within the sidewalls 23 acts as a parabolic reflector. In this manner, a highly directional luminous output may be produced with the luminaire 1. This is depicted by the polar plot in FIG. 4, which depicts the luminous output produced by a luminaire 1 having such a parabolic cross-section and containing a strip of SSL elements 31 within the recess 25. As can be seen from this polar plot, the beam produced by this luminaire 1 is highly directional (having a FWHM of about 36°).

Figure 5:
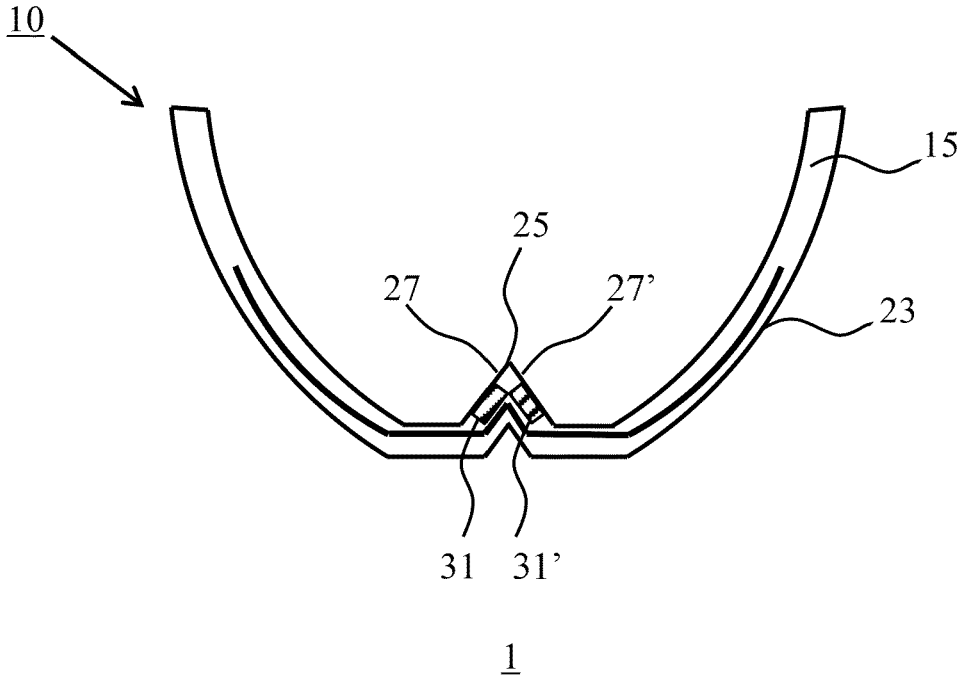
FIG. 5 schematically depicts a cross-sectional view of a luminaire and optically transmissive housing according to another embodiment.
Figure 6:
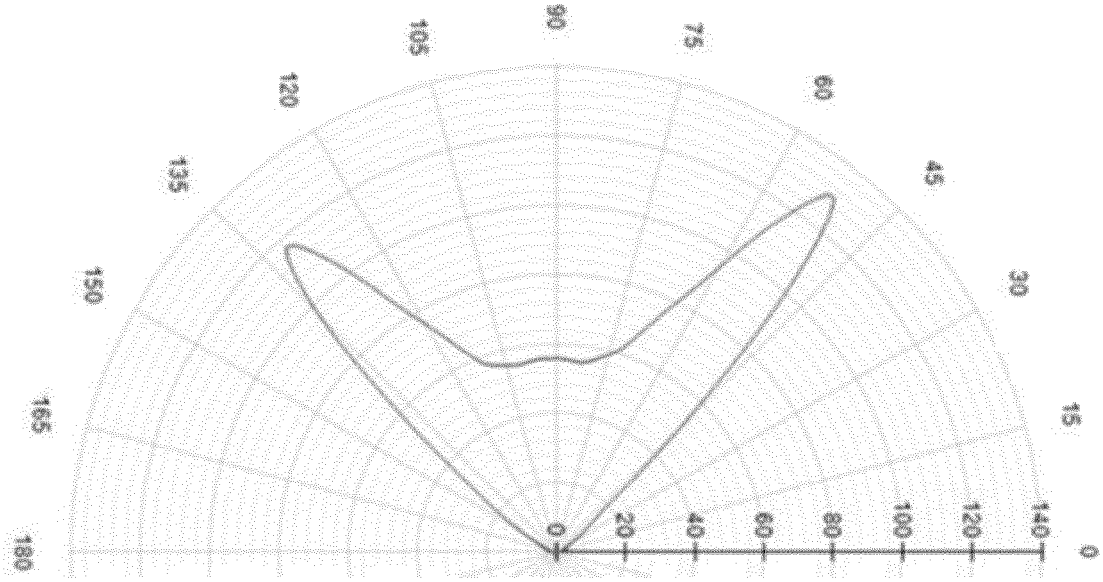
FIG. 6 is a polar plot of a luminous distribution produced by a luminaire according to another embodiment.

Of course, the cross-sectional shape of the optically transmissive housing 10 may be altered in accordance with the desired beam profile to be produced by the luminaire 1. In another example embodiment, which is schematically depicted in FIG. 5, the recess 25 within the elongate base region 21 comprises a first surface 27 abutting a second surface 27' under a non-zero angle, thereby forming a triangular or V-shaped cross-section. In this manner, a first carrier carrying one or more light engines 31 and a second carrier carrying one or more light engines 31' may be mounted facing the first surface 27 and the second surface 27' respectively such that the light engines 31, 31' on the respective carriers aim their luminous outputs at the respective sidewalls 23 of the optically transmissive housing 10 of the luminaire 1. This for example may be used to generate a batwing-type luminous distribution with the luminaire 1 as depicted by the polar plot in FIG. 6. It should be understood that such a batwing-type luminous distribution may be produced in any suitable manner, e.g. by tailoring the cross-sectional shape of the optically transmissive housing 10 in a direction perpendicular to its elongation direction (i.e. the elongation direction of the elongate base region 21) in order to reshape the reflector of the luminaire 1 in addition to or alternative to the shaping of the recess 25 as explained above.

Figure 7:
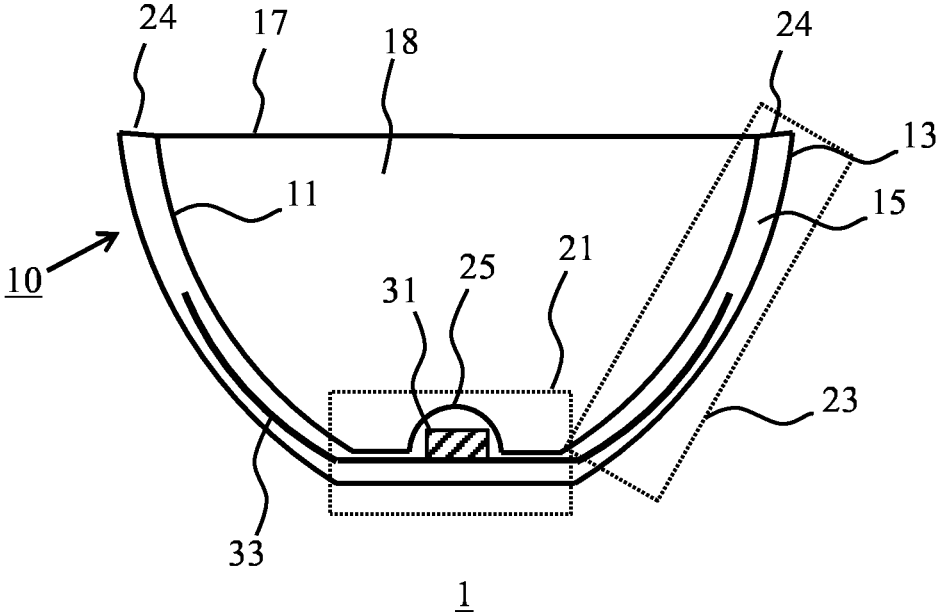
FIG. 7-11 schematically depict a cross-sectional views of a luminaire and optically transmissive housing according to further embodiments.
Figure 8:
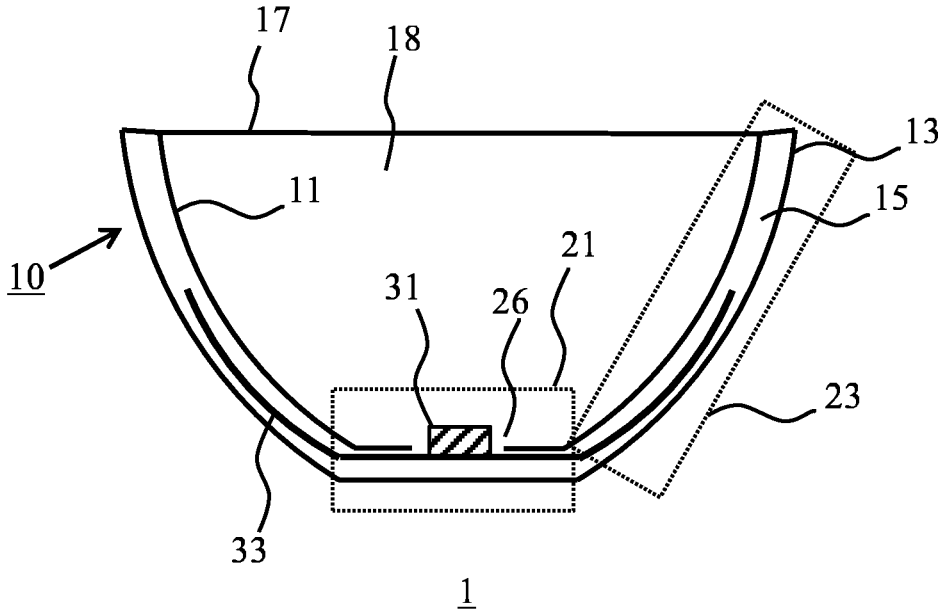
Figure 9:
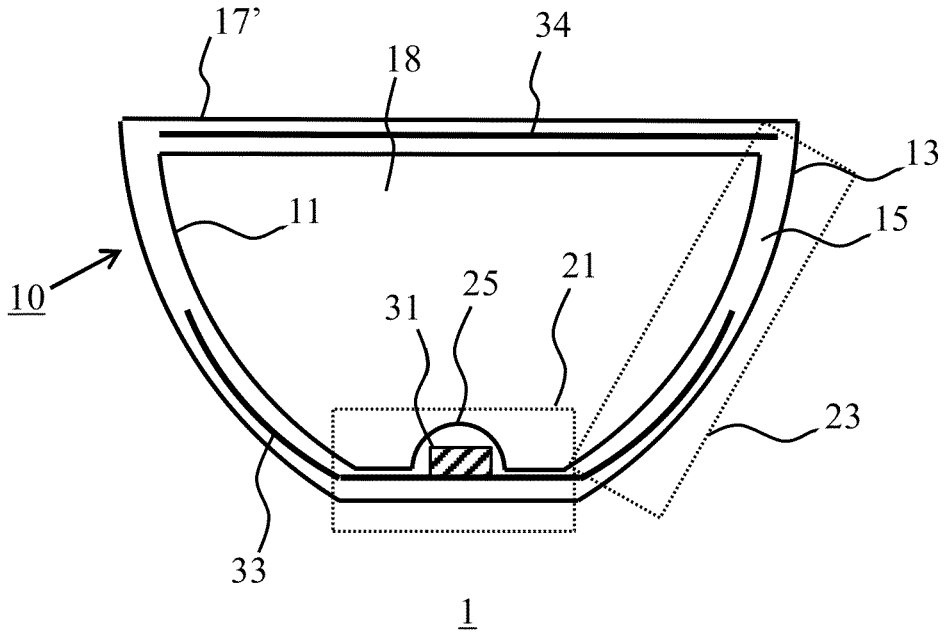

In the aforementioned embodiments, the chamber 18 is an open chamber. Alternatively, the chamber 18 may be sealed off by a light exit window 17 extending across the respective terminal ends 24 of the opposing elongate sidewalls 23 distal to the elongate base region 21, as schematically depicted in FIG. 7. This for example protects the inner surfaces 11 of the optically transmissive housing 10 from damage and contamination. In such an embodiment, the recess 25 in the elongate base region 21 covering the one or more light engines 31 may not be required, for example because there is no electrocution risk due to the fact that the light exit window 17 prevents a person from accessing the chamber 18. In such embodiments, the recess 25 may be replaced by an elongate opening 26 in the portion of the inner surface 11 belonging to the elongate base region 21 through which the one or more light engines 31 may protrude into the chamber 18 as schematically depicted in FIG. 8. It will be readily understood by the skilled person that the elongation direction of the opening 26 coincides with the elongation direction of the elongate base region 21, i.e. elongate opening 21 extends across the elongated base region 21 in its elongation direction. The light exit window 17 preferably is made of the same material as the inner and outer surfaces 11, 13 of the optically transmissive housing 10, such that the optically transmissive housing 10 may be manufactured in a simple and cost-effective manner. In FIGS. 7 and 8 the light exit window 17 is a single-skinned structure. In an alternative embodiment schematically depicted in FIG. 9, the light exit window 17' is a double-skinned structure such that the cavity 15 extends across the light exit window 17'. This extension of the cavity for instance may be utilized to insert an optical component such as a diffuser foil 34 or the like in this part of the cavity 15 in order to further shape the luminous output of the luminaire 1.

Figure 10:
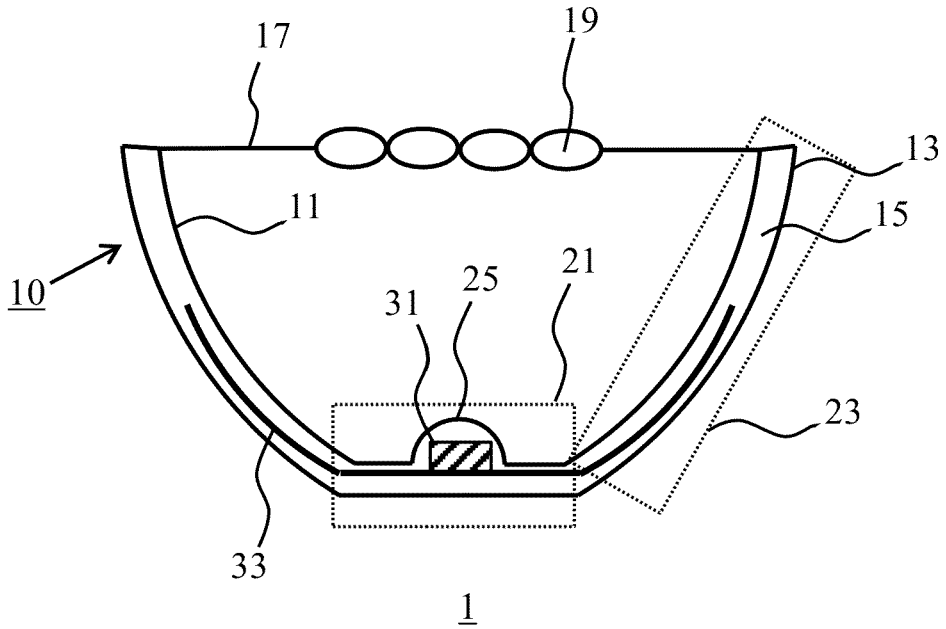
Figure 11:
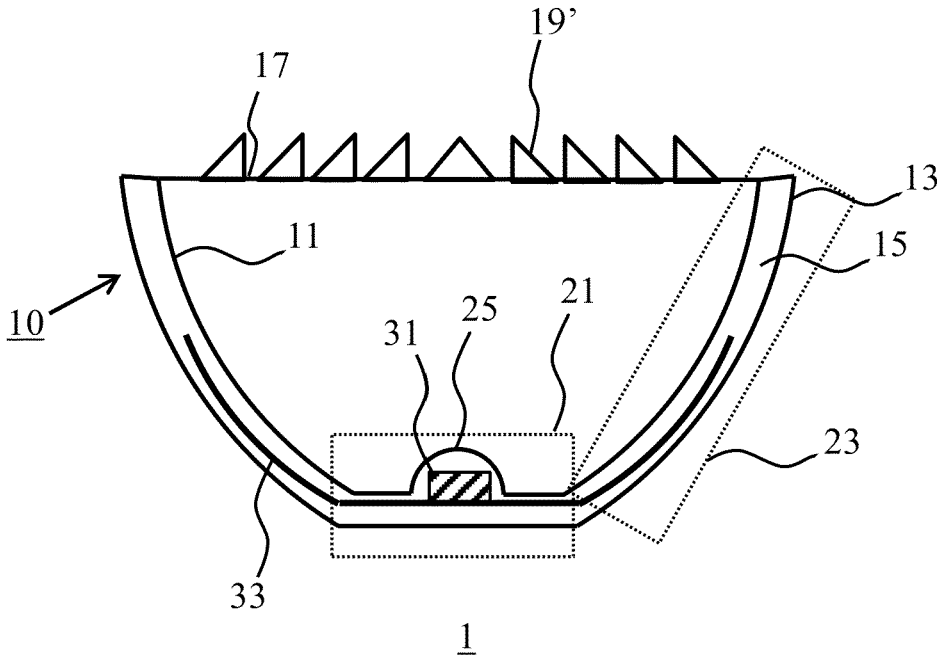

The light exit window 17, 17' may be optically transparent of optically translucent, e.g. may act as a diffuser of the luminous output of the luminaire 1, e.g. by patterning or roughening a single-skinned light exit window 17 or by insertion of an optical foil in the double-skinned light exit window 17' as explained above. In yet another embodiment, the light exit window 17 may carry a plurality of beam shaping elements for shaping the luminous distribution (i.e. the produced beam) of the luminaire 1. FIG. 10 schematically depicts an example embodiment in which a plurality of micro-lenses 19 are integrated in the light exit window 17, whereas FIG. 11 schematically depicts another example embodiment in which a plurality of Fresnel facets 19' are integrated in the light exit window 17. Such beam shaping elements for example may be used to diverge the beam produced by the luminaire 1 that is incident on the light exit window 17.

Figure 12:
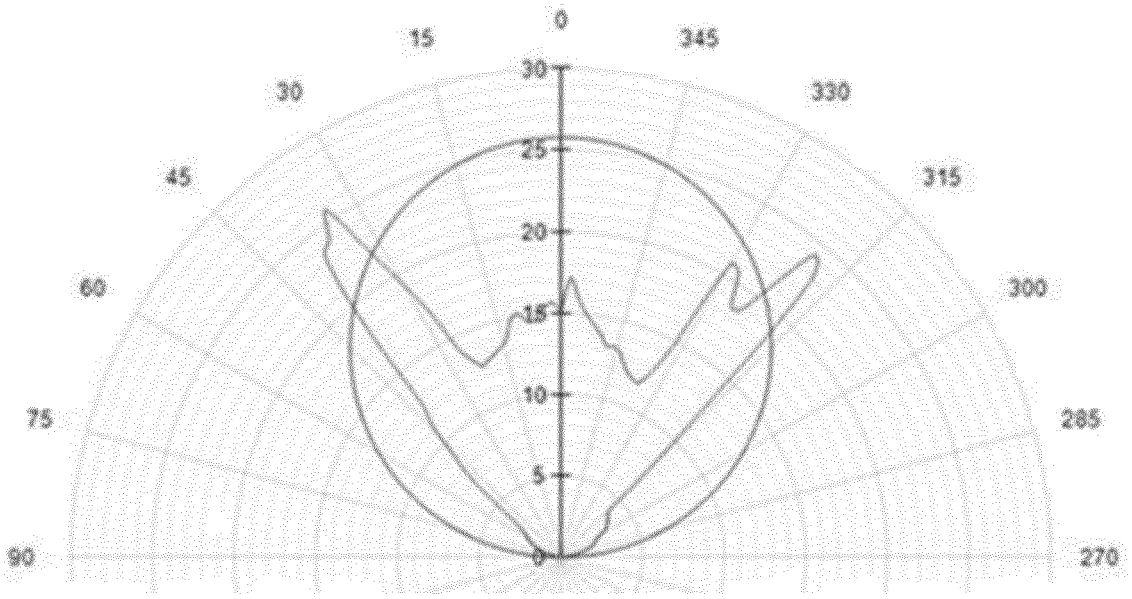
FIG. 12 is a polar plot of a luminous distribution produced by a luminaire according to a further embodiment.

FIG. 12 depicts a polar plot 1 in which a plurality of LEDs were mounted on a diffusively reflective heat sink, which subsequently was inserted into the optically transmissive housing 10. A plurality of beam diverging elements were included in a central region of the light exit window 17 to reduce the intensity of the central portion of the beam produced by the luminaire 1 and increase the intensity of the wings (sides) of this beam, as can be seen in this polar plot. In this manner, a batwing type luminous distribution having high-intensity wings in the luminous profile produced by the luminaire 1 could be realized.

At this point, it is noted that such beam shaping elements 19, 19' may be located in any suitable location on the optically transmissive housing 10. In particular, such beam shaping elements 19, 19' may be positioned on the surface of the recess 25 facing the chamber 18 in order to shape the luminous profile produced by the luminaire 1 as will be readily understood by the skilled person.

Figure 13:
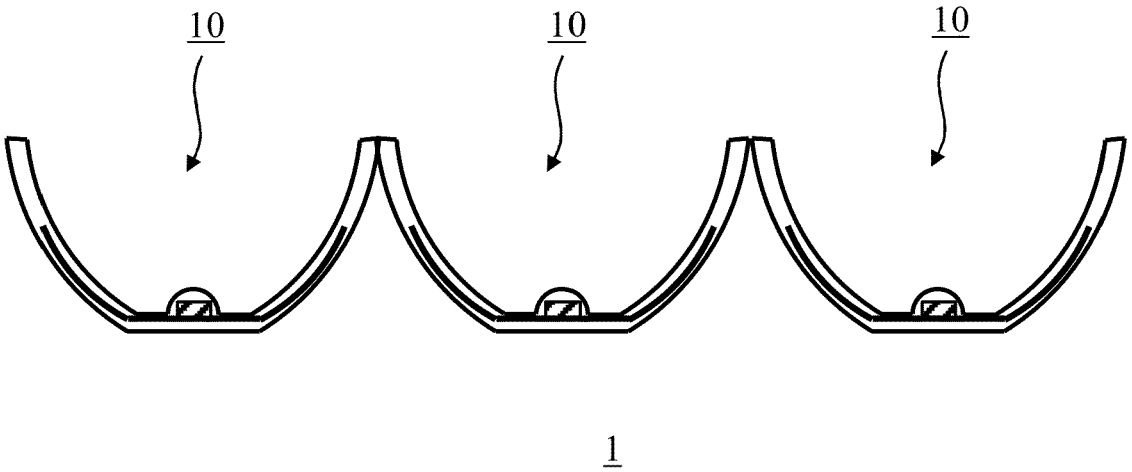
FIG. 13 schematically depicts a cross-sectional view of a luminaire and a plurality of optically transmissive housings according to still another embodiment.

FIG. 13 schematically depicts a luminaire 1 according to yet another example embodiment, in which the luminaire 1 comprises a plurality of optically transmissive housings 10 arranged in a side-by-side arrangement such that the optically transmissive housings 10 neighbor each other in a direction perpendicular to the respective elongation directions of said housings. As will be immediately apparent to the skilled person, each of the housing 10 will comprise its own one or more light engines 31 and one or more members 33 located within its cavity 15. In this manner, a large area luminaire 1 may be formed, such as a rectangular, e.g. a square, troffer or the like.

Figure 14:
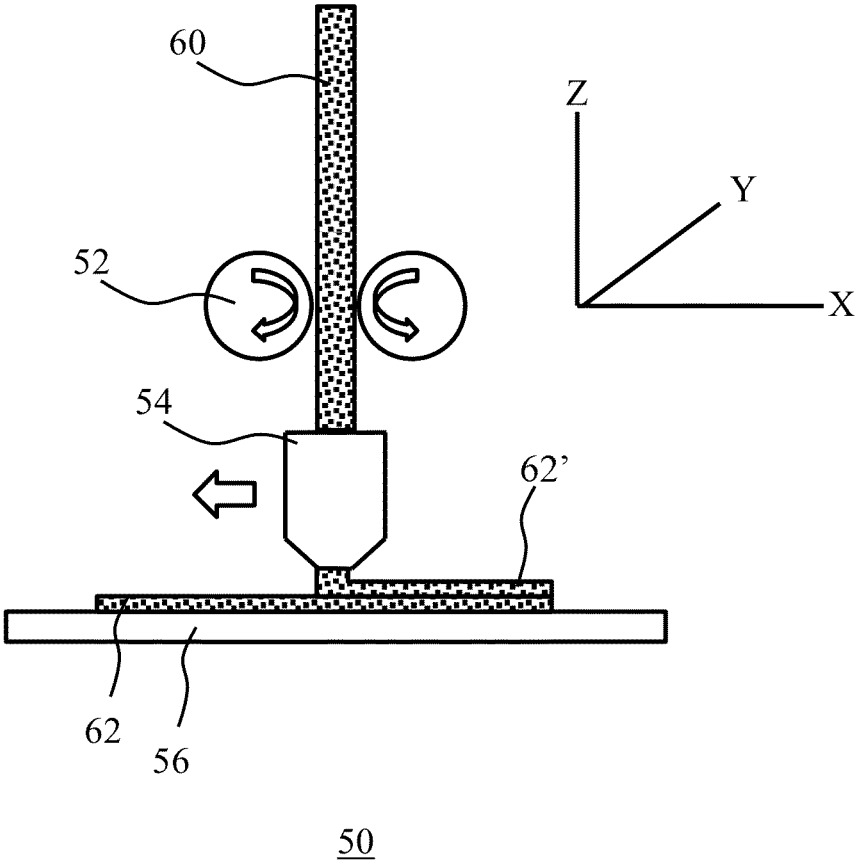
FIG. 14 schematically depicts an example manufacturing setup for an optically transmissive housing according to embodiments of the present invention.

The luminaire 1 may be manufactured in any suitable manner, such as by extrusion. However, in a preferred embodiment the luminaire 1 is manufactured using 3-D printing such as fused deposition modelling printing. FDM printers such as the printer 50 schematically depicted in FIG. 14 use a thermoplastic filament 60, which is fed into a heated extruder nozzle 54 by drive wheels 52, where heated to its melting point and then extruded, layer 62 by layer 62', onto a heated platform 56 to create a three dimensional object. A layer 62, 62' from which the optically transmissive housing 10 is formed is deposited onto the heated print platform 56 while in a high viscosity liquid state, which then cools and becomes solid upon cooling.

Figure 15:
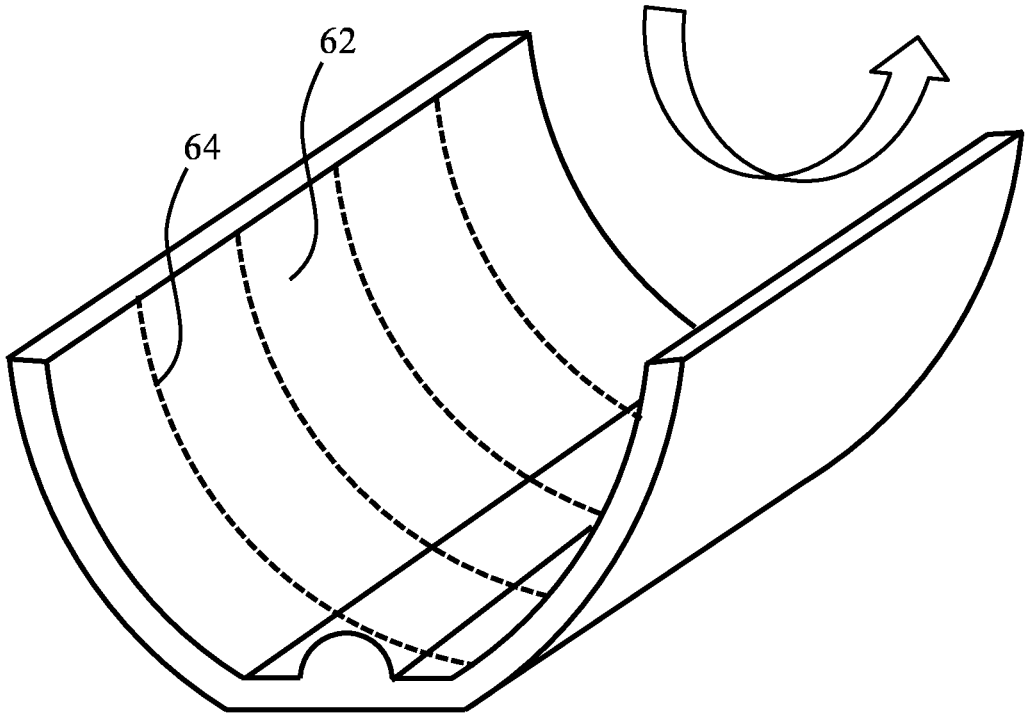
FIG. 15 schematically depicts a perspective view of an optically transmissive housing manufactured with such a manufacturing setup.

In this manner, a 3D structure may be built up as a sequence of layer patterns, e.g. the layers 62, 62' to form the optically transmissive housing 10. This is schematically depicted in FIG. 15. The optically transmissive housing 10 preferably is printed in a vertical manner as indicated by the block arrow in FIG. 15 such that the respective layers 62 extend in a direction perpendicular to the elongation direction of the optically transmissive housing 10. The reason for this is that the joins 64 in between adjacent filament layers 62 then extend perpendicularly to this elongation direction, i.e. perpendicularly to an elongate strip of light engines 31 extending through the elongate base region 21 of the optically transmissive housing 10. As is well-known per se, such joins 64 are typically formed when adjacent filament layers 62 are pressed against each other during the 3-D printing process.

It surprisingly has been found that if the joins 64 extend perpendicular to such an elongate strip of light engines 31 rather than in parallel with such a strip, the optical performance of a luminaire 1 including such an optically transmissive housing 10 is improved as the joins 64 do not significantly interfere with the beam shaping capabilities of the optically transmissive housing 10, whereas such interference is much more pronounced when the joins 64 run in parallel with such a strip of light engines 31. In fact, in at least some of the luminaire designs, such perpendicular joins 64 were shown to aid the formation of particularly directional (narrow) beams with the luminaire 1, in particular where the optically transmissive housing 10 had a parabolic cross-sectional as previously explained. The joins 64 may take any suitable shape, such as the shape of a protrusion or rib in between adjacent filament layers 62 or a depression in between adjacent filament layers 62. After insertion of the various (optical) components such as the light engine 31, one or more members 33, diffuser foil 34, electrical components 35 and so on, the optically transmissive housing 10 may be sealed, preferably through 3-D printing or alternatively with a sealant, to weatherproof or waterproof the optically transmissive housing 10.

In a preferred embodiment, the designs of the optically transmissive housing 10 preferably are made such that a so-called spiralized printing strategy in which the printer head including the extruder nozzle 54 can move along a single line without the need for a jump can be deployed. In yet another embodiment, the printer head is capable of printing a plurality of filament layers 62 at the same time, e.g. the extruder nozzle 54 comprises a plurality of filament feeders, such that multiple layers 62 of the optically transmissive housing 10 can be printed simultaneously. During printing, the support 56 on which the optically transmissive housing 10 is formed may be rotated in order to form the optically transmissive housing 10 or alternatively the extruder nozzle 52 may be rotated during the 3-D printing of a layer 62 of the optically transmissive housing 10 to form the 3-D shape of the optically transmissive housing 10.

FDM printers are relatively fast, low cost and can be used for printing complicated 3D objects. Such a 3-D printing setup is well-known per se and is therefore not explained in further detail for the sake of brevity only. Such printers may be used for printing various shapes using various polymers, as also is well-known per se. To perform a 3D printing process, the printer may be controlled using a print command file generated by computer aided design (CAD) software specifying the 3-D shape of the optically transmissive housing 10, and this controls how the filament is processed.

Any suitable material may be used for forming the respective layers 62 of the optically transmissive housing 10. For example, these may be materials suitable for use in a 3-D printing process, e.g. polymers that may be extruded in an FDM printing process.

As indicated above, the method comprises depositing during a printing stage 3D printable material. Herein, the term "3D printable material" refers to the material to be deposited or printed, and the term "3D printed material" refers to the material that is obtained after deposition. These materials may be essentially the same, as the 3D printable material may especially refer to the material in a printer head or extruder at elevated temperature and the 3D printed material refers to the same material, but in a later stage when deposited. The 3D printable material is printed as a filament and deposited as such. The 3D printable material may be provided as filament or may be formed into a filament. Hence, whatever starting materials are applied, a filament comprising 3D printable material is provided by the printer head and 3D printed.

Herein, the term "3D printable material" may also be indicated as "printable material. The term "polymeric material" may in embodiments refer to a blend of different polymers, but may in embodiments also refer to essentially a single polymer type with different polymer chain lengths. Hence, the terms "polymeric material" or "polymer" may refer to a single type of polymers but may also refer to a plurality of different polymers. The term "printable material" may refer to a single type of printable material but may also refer to a plurality of different printable materials. The term "printed material" may refer to a single type of printed material but may also refer to a plurality of different printed materials.

Hence, the term "3D printable material" may also refer to a combination of two or more materials. In general, these (polymeric) materials have a glass transition temperature Tg and/or a melting temperature Tm. The 3D printable material will be heated by the 3D printer before it leaves the nozzle to a temperature of at least the glass transition temperature, and in general at least the melting temperature. Hence, in a specific embodiment the 3D printable material comprises a thermoplastic polymer having a glass transition temperature (Tg) and/or a melting point (Tm), and the printer head action comprises heating the 3D printable material above the glass transition and if it is a semi-crystalline polymer above the melting temperature. In yet another embodiment, the 3D printable material comprises a (thermoplastic) polymer having a melting point (Tm), and the printer head action comprises heating the 3D printable material to be deposited on the receiver item to a temperature of at least the melting point. The glass transition temperature is in general not the same thing as the melting temperature. Melting is a transition which occurs in crystalline polymers. Melting happens when the polymer chains fall out of their crystal structures, and become a disordered liquid. The glass transition is a transition which happens to amorphous polymers; that is, polymers whose chains are not arranged in ordered crystals, but are just strewn around in any fashion, even though they are in the solid state. Polymers can be amorphous, essentially having a glass transition temperature and not a melting temperature or can be (semi) crystalline, in general having both a glass transition temperature and a melting temperature, with in general the latter being larger than the former.

As indicated above, the invention thus provides a method comprising providing at least one filament of 3D printable material and printing during a printing stage said 3D printable material on a substrate, to provide said 3D item. Materials that may especially qualify as 3D printable materials may be selected from the group consisting of metals, glasses, thermoplastic polymers, silicones, etc. Especially, the 3D printable material comprises a (thermoplastic) polymer selected from the group consisting of ABS (acrylonitrile butadiene styrene), Nylon (or polyamide), Acetate (or cellulose), PLA (poly lactic acid), polycarbonate (PC), terephthalate (such as PET polyethylene terephthalate), styrene acrylonitryl (SAN), Acrylic (polymethylacrylate, polymethylmethacrylate (PMMA), Polyacrylonitrile), copolymers of (metha)acrylates Polypropylene (or polypropene), Polystyrene (PS), PE (such as expanded—high impact-Polythene (or polyethene), Low density (LDPE) High density (HDPE)), PVC (polyvinyl chloride) Polychloroethene, etc. Polypropylene and polyethylene (LDPE, HDPE) are particularly mentioned as a suitable material for the inner surface 11 and outer surface 13 of the housing 10 due to their transparency to infrared radiation. Optionally, the 3D printable material comprises a 3D printable material selected from the group consisting of Urea formaldehyde, Polyester resin, Epoxy resin, Melamine formaldehyde, Polycarbonate (PC), thermoplastic elastomer, etc. Optionally, the 3D printable material comprises a 3D printable material selected from the group consisting of a polysulfone.

Highly transmissive polymers can be selected from Polycarbonate (PC), Polyacrylics such as Polymethylmethacrylate (PMMA), aromatic polyesters such as polyethylenetelepthalate (PET), non-aromatic polyesters and copolymers thereof. Polystyrene, Styrene acrylonitryl, styrene methacrylate (SMA). The printable material may be printed on a receiver item. Especially, the receiver item may be the print platform 56 or may be comprised by the print platform 56. The receiver item can also be heated during 3D printing. However, the receiver item may also be cooled during 3D printing.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A housing for a lighting device, wherein the housing comprises an elongate base region and opposing elongate sidewalls extending from opposite elongate sides of the elongate base region towards respective terminal ends, wherein each of the opposing elongate sidewalls has an optically transmissive inner surface separated from an outer surface by a distance of 5 millimeters or less to form a cavity for housing a reflective foil or a thermally conductive member, wherein the inner surface extends across the elongate base region, and wherein the inner surface comprises a recess in the elongate base region for housing a light engine, wherein the housing further comprises a light exit window extending across the respective terminal ends of the opposing elongate sidewalls distal to the elongate base region.

2. The housing according to claim 1, wherein the housing is made of a polymer or polymer blend.

3. The housing according to claim 1, wherein the light exit window is double-skinned such that the cavity extends into the light exit window.

4. The housing according to claim 3, wherein the light exit window carries a pattern of beam shaping elements for shaping a luminous output emanating from the elongate base region.

5. The housing according to claim 1, wherein the cavity in the opposing elongate sidewalls and the recess in the elongate base region are interconnected to form a single cavity that extends across the opposing sidewalls and the elongate base region.

6. The housing according to claim 1, wherein the recess comprises a first elongate surface portion adjoining a further elongate surface portion along the elongation direction of the elongate base region under a non-zero angle.

7. The housing according to claim 1, wherein the housing has a parabolic cross-section in a direction perpendicular to the elongation direction of the elongate base region.

8. The housing according to claim 1, further comprising a plurality of joins extending across the housing in a direction perpendicular to the elongation direction of the elongate base region.

9. A luminaire comprising the housing according to claim 1 and at least one light engine housed in the recess of the elongate base region.

10. The luminaire according to claim 9, wherein the at least one light engine comprises an elongate strip carrying a plurality of said light engines.

11. The luminaire according to claim 9, wherein the luminaire further comprising at least one of:

- a reflective foil extending into the cavity located within the opposing side walls;
- a thermally conductive member extending into the cavity located within the opposing side walls; and
- a diffuser foil in a double-skinned light exit window extending across the respective terminal ends of the opposing elongate sidewalls distal to the elongate base region.

12. The luminaire according to claim 9, wherein the luminaire comprises a plurality of said housings neighboring each other in a direction perpendicular to the respective elongation directions of said housings.

13. A method of manufacturing the housing according to claim 1, wherein the method comprises the steps of:

- providing a 3-D printing apparatus comprising an extruder nozzle having at least one filament feeder for feeding a preformed filament through the extruder nozzle;
- 3-D printing a plurality of abutting filaments with the 3-D printing apparatus, each of said printed filaments defining a portion of the housing including a section of the inner surface and the outer surface, said portion extending in a direction perpendicular to the elongation direction of the housing.

14. The method according to claim 13, wherein the extruder nozzle has a plurality of filament feeders, and wherein the step of 3-D printing comprises printing at least some of the abutting filaments in parallel.

* * * * *